US009885357B2

(12) United States Patent
Yokoyama et al.

(10) Patent No.: US 9,885,357 B2
(45) Date of Patent: Feb. 6, 2018

(54) HERMETIC COMPRESSOR AND VAPOR COMPRESSION-TYPE REFRIGERATION CYCLE DEVICE INCLUDING THE HERMETIC COMPRESSOR

(71) Applicants: Tetsuhide Yokoyama, Chiyoda-ku (JP); Teruhiko Nishiki, Chiyoda-ku (JP); Shogo Moroe, Chiyoda-ku (JP); Taro Kato, Chiyoda-ku (JP); Keisuke Shingu, Chiyoda-ku (JP); Shin Sekiya, Chiyoda-ku (JP); Toshihide Koda, Chiyoda-ku (JP)

(72) Inventors: Tetsuhide Yokoyama, Chiyoda-ku (JP); Teruhiko Nishiki, Chiyoda-ku (JP); Shogo Moroe, Chiyoda-ku (JP); Taro Kato, Chiyoda-ku (JP); Keisuke Shingu, Chiyoda-ku (JP); Shin Sekiya, Chiyoda-ku (JP); Toshihide Koda, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 202 days.

(21) Appl. No.: 14/761,511

(22) PCT Filed: Jan. 16, 2013

(86) PCT No.: PCT/JP2013/050636
§ 371 (c)(1),
(2) Date: Jul. 16, 2015

(87) PCT Pub. No.: WO2014/112046
PCT Pub. Date: Jul. 24, 2014

(65) Prior Publication Data
US 2015/0354572 A1 Dec. 10, 2015

(51) Int. Cl.
*F04C 23/02* (2006.01)
*F04C 23/00* (2006.01)
(Continued)

(52) U.S. Cl.
CPC ..... *F04C 23/02* (2013.01); *F04B 39/0246* (2013.01); *F04C 18/0215* (2013.01);
(Continued)

(58) Field of Classification Search
CPC .... F04C 14/02; F04C 15/003; F04C 15/0088; F04C 23/005; F04C 23/02; F04C 27/007;
(Continued)

(56) References Cited

U.S. PATENT DOCUMENTS 5,533,875 A * 7/1996 Crum ..... F04C 23/008 417/368
2003/0086798 A1* 5/2003 Tani ..... F04C 23/008 417/366
(Continued)

FOREIGN PATENT DOCUMENTS

JP 52-24805 Y2 6/1977
JP 57-68583 A 4/1982
(Continued)

OTHER PUBLICATIONS

International Search Report dated Apr. 23, 2013, in PCT/JP2013/050636, filed Jan. 16, 2013.
(Continued)

*Primary Examiner* — Bryan Lettman
*Assistant Examiner* — Timothy Solak
(74) *Attorney, Agent, or Firm* — Oblon, McClelland, Maier & Neustadt, L.L.P.

(57) ABSTRACT

A hermetic compressor includes a hermetic container having a bottom portion in which lubricating oil is stored and an electric motor including a stator and a rotator. The hermetic
(Continued)

compressor further includes a drive shaft attached to the rotator and a compression mechanism for compressing refrigerant by using rotation of the drive shaft. The hermetic compressor also includes a rotary pressure increasing mechanism for increasing a pressure of refrigerant gas, the rotary pressure increasing mechanism being arranged on the rotator, and a cylindrical lateral wall for partitioning a space above the electric motor into an outer space and an inner space in a manner that the a cylindrical lateral wall surrounds the rotary pressure increasing mechanism. Finally, the hermetic compressor includes a discharge pipe for allowing the refrigerant to flow out from the inner space into an external circuit that is external to the hermetic container.

10 Claims, 9 Drawing Sheets

(51) Int. Cl.

| | |
|---|---|
| ***F04C 18/02*** | (2006.01) |
| ***F04C 29/02*** | (2006.01) |
| ***F04B 39/02*** | (2006.01) |
| *F04C 28/02* | (2006.01) |
| *F04C 29/00* | (2006.01) |
| *F04C 29/04* | (2006.01) |
| *F04C 29/12* | (2006.01) |

(52) U.S. Cl.
CPC ..... *F04C 18/0261* (2013.01); *F04C 23/005* (2013.01); *F04C 23/008* (2013.01); *F04C 29/026* (2013.01); *F04C 28/02* (2013.01); *F04C 29/0085* (2013.01); *F04C 29/045* (2013.01); *F04C 29/12* (2013.01)

(58) Field of Classification Search
CPC F04C 27/008; F04C 29/0028; F04C 29/0092; F04C 29/023; F04C 29/028; F04C 29/026; F04C 18/026; F04C 15/008; F04C 2210/14; F04C 18/0261; F04C 29/045; F04C 28/02; F04B 39/0238; F04B 39/0253; F04B 39/0261; F25B 31/026

See application file for complete search history.

(56) References Cited

U.S. PATENT DOCUMENTS

| | | | | |
|---|---|---|---|---|
| 2008/0038133 | A1* | 2/2008 | Sawai | F04C 18/0215 418/55.2 |
| 2008/0078618 | A1* | 4/2008 | Lee | F04C 18/356 184/6.2 |
| 2011/0067434 | A1* | 3/2011 | Miura | F01C 21/02 62/498 |
| 2012/0107151 | A1* | 5/2012 | Yokoyama | F04B 39/16 417/366 |

FOREIGN PATENT DOCUMENTS

| | | | |
|---|---|---|---|
| JP | 05-61487 | U | 8/1993 |
| JP | 3925392 | B2 | 6/2007 |
| JP | 2009-264175 | A | 11/2009 |
| JP | 2010-265849 | A | 11/2010 |

OTHER PUBLICATIONS

Combined Office Action and Search Report dated Jul. 5, 2016 in Chinese Patent Application No. 201380070654.5 (with partial English translation and English translation of Categories of Cited Documents).

* cited by examiner

HERMETIC COMPRESSOR AND VAPOR COMPRESSION-TYPE REFRIGERATION CYCLE DEVICE INCLUDING THE HERMETIC COMPRESSOR

TECHNICAL FIELD

The present invention relates to a hermetic compressor, and a vapor compression-type refrigeration cycle device including the hermetic compressor. In particular, the present invention relates to a hermetic compressor excellent in oil separation effect, and a vapor compression-type refrigeration cycle device including the hermetic compressor.

Citation List

Patent Literature

Patent Literature 1: Japanese Patent No. 3925392

Patent Literature 2: Japanese Unexamined Utility Model Application Publication No. Hei 5-61487

Patent Literature 3: Japanese Unexamined Patent Application Publication No. 2009-264175

BACKGROUND ART

Hitherto, in a refrigerant compressor used in vapor compression-type refrigeration cycle devices (such as heat pump equipment and refrigeration cycle equipment), a rotational force of an electric motor is transmitted to a compression mechanism by a drive shaft so that refrigerant gas is compressed. In such a refrigerant compressor, the refrigerant gas compressed by the compression mechanism is discharged into a hermetic container, moved from a space below the electric motor into a space above the same through electric motor unit gas passages, and then discharged into a refrigerant circuit on an outside of the hermetic container. At this time, lubricating oil supplied to the compression mechanism and mixed with the refrigerant gas is discharged to the outside of the hermetic container. Hitherto, there is a problem in that an increase in amount of the oil to be discharged into the refrigerant circuit causes degradation in performance of a heat exchanger. In addition, there is another problem in that a decrease in amount of the oil stored in the hermetic container causes insufficient lubrication, resulting in degradation in reliability of the refrigerant compressor.

In recent years, there have been promoted development of refrigerant compressors having smaller sizes, and conversion to use of alternative refrigerants (including natural refrigerant) having a lower environmental load. Under the circumstances, advanced technology for separating the oil in the hermetic container has been demanded. However, how the refrigerant and the lubricating oil flow and how the oil separation occurs during high speed rotation of the electric motor in the hermetic container are significantly complicated, and observation experiments in the hermetic container under high pressure are not easy. Thus, there are a large number of unknown factors, and a large number of technical problems have not yet been solved.

In the high-pressure shell type scroll compressor disclosed in Patent Literature 1, sucked refrigerant is compressed by the compression mechanism arranged on an upper side in the hermetic container, and once caused to flow down to an oil reservoir at a bottom of the hermetic container. After that, the refrigerant is caused to flow up from a space below the electric motor to a space above the same through electric motor gas passages, and then discharged as high pressure gas through a discharge pipe of the compressor. The high-pressure shell type scroll compressor disclosed in Patent Literature 1 includes a fan arranged on an upper portion of a rotator of the electric motor, and partition walls for separating a stator side of the electric motor and a rotator side of the electric motor from each other above the fan. Then, the refrigerant and the lubricating oil are separated from each other by using a centrifugal force generated by rotation of the fan and by using pressure resistance generated through gaps between the partition walls. The lubricating oil is prevented from flowing directly into the discharge pipe without being separated from the refrigerant, in other words, the lubricating oil is prevented from flowing out from the hermetic container.

Further, in Patent Literature 2, there is disclosed an oil separation device for a hermetic electric compressor including: an electric component housed in an upper portion of a hermetic container; a compression component that is driven by the electric component; an oil separation plate arranged to face an upper end ring of a rotor of the electric component across a predetermined clearance; and stirring vanes arranged upright to the oil separation plate, in which the stirring vanes are arranged upright only to a lower surface of the oil separation plate.

Effects of improving an oil separation condition in the hermetic container of the compressor by using the fan and the partition walls in Patent Literature 1 and the oil separation plate and the stirring vanes in Patent Literature 2 are generally observed.

Further, in recent years, by using significantly advanced three-dimensional fluid simulation technology, flow conditions of the refrigerant and the lubricating oil in the hermetic container of the compressor can be visualized. Thus, new findings are obtained. Specifically, in Patent Literature 3, there is disclosed a refrigerant compressor in which an increase in head pressure that is generated near a leading end in a rotation direction of an upper balance weight at an upper end of the rotator of the electric motor arranged in the hermetic container is used to form an oil return passage from a vicinity of a leading end portion toward a lower end so that high density lubricating oil that appears around the rotator is returned below the electric motor, to thereby prevent the oil from flowing out.

SUMMARY OF INVENTION

Technical Problem

In general, to provide a high-performance centrifugal air-sending device, as described in Non Patent Literature 1, the shape of the impeller itself, the shape of the passage of flow extending into the impeller, the shape of the passage of flow extending outside of the impeller, and the like need to be theoretically designed.

However, in Patent Literatures 1 and 2, no theoretical design methods are disclosed for the fan and the vanes that are each attached on the upper portion of the rotator (rotor) of the electric motor disclosed therein, and optimum configurations for the fan and the vanes for improving the oil separation condition have not yet been specified.

Specifically, in the high-pressure shell type scroll compressor disclosed in Patent Literature 1, unless the fan and the partition walls to be attached on the upper portion of the rotator of the electric motor are appropriately designed and arranged, the fan and the partition walls cannot prevent the refrigerant, which flows from the compression mechanism into the space above the electric motor (refrigerant mixed with fine oil particles), from flowing from the stator side of the electric motor directly into the rotator side of the electric motor. Thus, there is a problem in that the oil separation effect cannot be fully exerted.

The present invention has been made to solve the problem as described above, and it is an object thereof to provide a hermetic compressor capable of reducing an amount of oil flowing to an outside of a hermetic container than that in the related art by using rotation of a rotator of an electric motor arranged in the hermetic container, and to provide a vapor compression-type refrigeration cycle device including the hermetic compressor.

Solution to Problem

According to one embodiment of the present invention, there is provided a hermetic compressor, including: a hermetic container having a bottom portion for storing lubricating oil; an electric motor arranged in the hermetic container, the electric motor including: a stator and a rotator through which rotator vents are formed in a vertical direction; a drive shaft attached to the rotator; a compression mechanism arranged in the hermetic container, for compressing refrigerant by using rotation of the drive shaft; a rotary pressure increasing mechanism arranged on an upper portion of the rotator, for increasing a pressure of refrigerant gas by allowing the refrigerant gas to flow through the rotary pressure increasing mechanism while rotating about the drive shaft; a cylindrical lateral wall for partitioning a space above the electric motor into an outer space on the stator side in such a manner that the cylindrical lateral wall surrounds the rotary pressure increasing mechanism; and a discharge pipe communicated to the inner space, for allowing the refrigerant to flow out from the inner space into an external circuit that is external to the hermetic container, in which the refrigerant gas that is compressed by the compression mechanism and discharged into the hermetic container is moved from a space below the electric motor up to an upper end of the rotator through the rotator vents, flows into the rotary pressure increasing mechanism to be increased in pressure, flows into the inner space to increase a pressure in the inner space, and is discharged to an outside through the discharge pipe while suppressing inflow of the refrigerant gas from the outer space to the inner space.

Further, according to one embodiment of the present invention, there is provided a vapor compression-type refrigeration cycle device, including: the hermetic compressor of the one embodiment of the present invention; a radiator for transferring heat of refrigerant that is compressed by the hermetic compressor; an expansion mechanism for expanding the refrigerant that flows out from the radiator; and an evaporator for causing the refrigerant that flows out from the expansion mechanism to receive heat.

Advantageous Effects of Invention

The one embodiment of the present invention can prevent a decrease in amount of lubricating oil stored in the hermetic container and can obtain an effect of suppressing reliability degradation to be caused by insufficient lubrication, and an effect of achieving high energy-saving performance.

DESCRIPTION OF EMBODIMENTS

Embodiment 1

Figure 1:
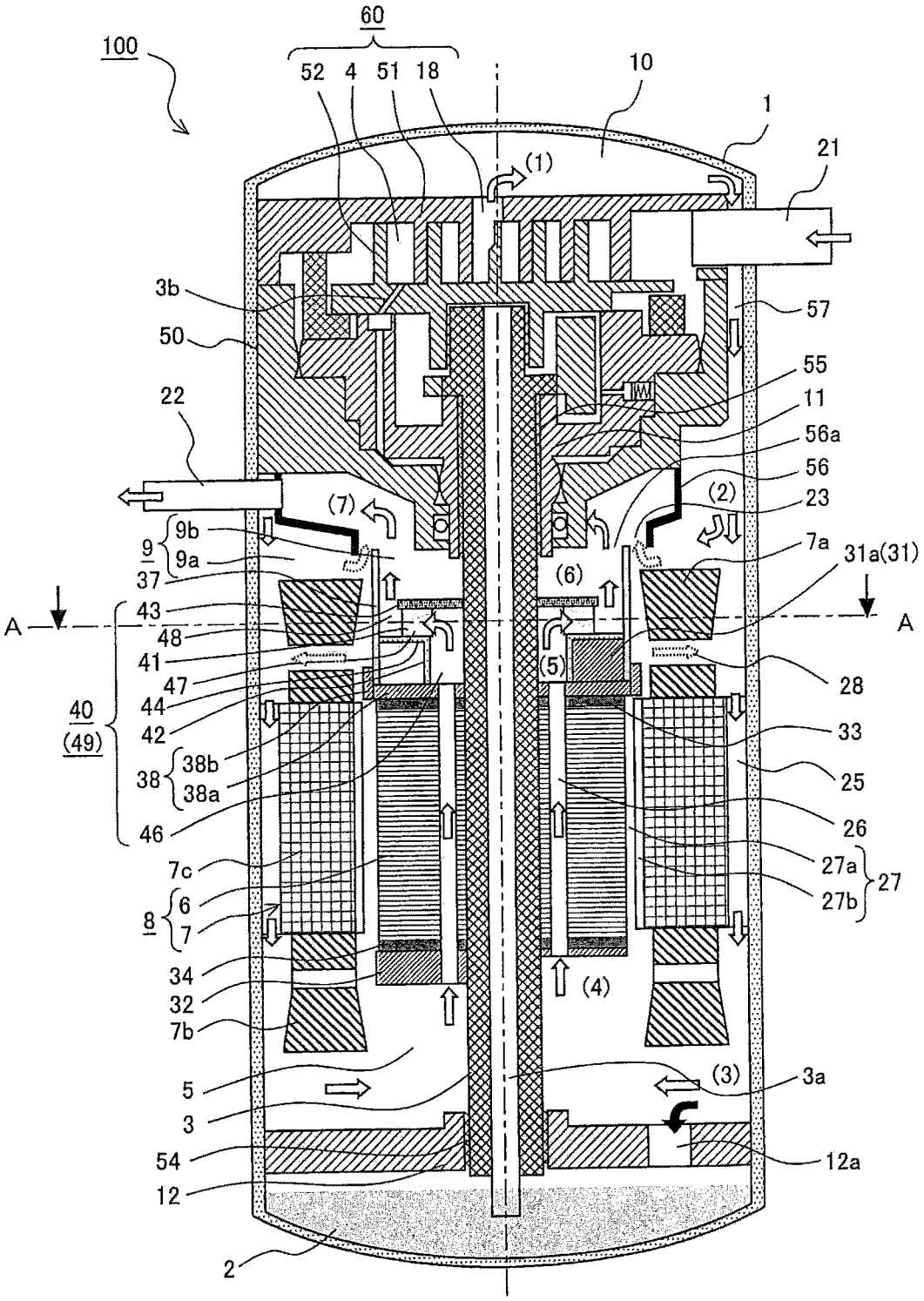
FIG. 1 is a vertical sectional view of a structure of a hermetic compressor according to Embodiment 1 of the present invention.
Figure 2:
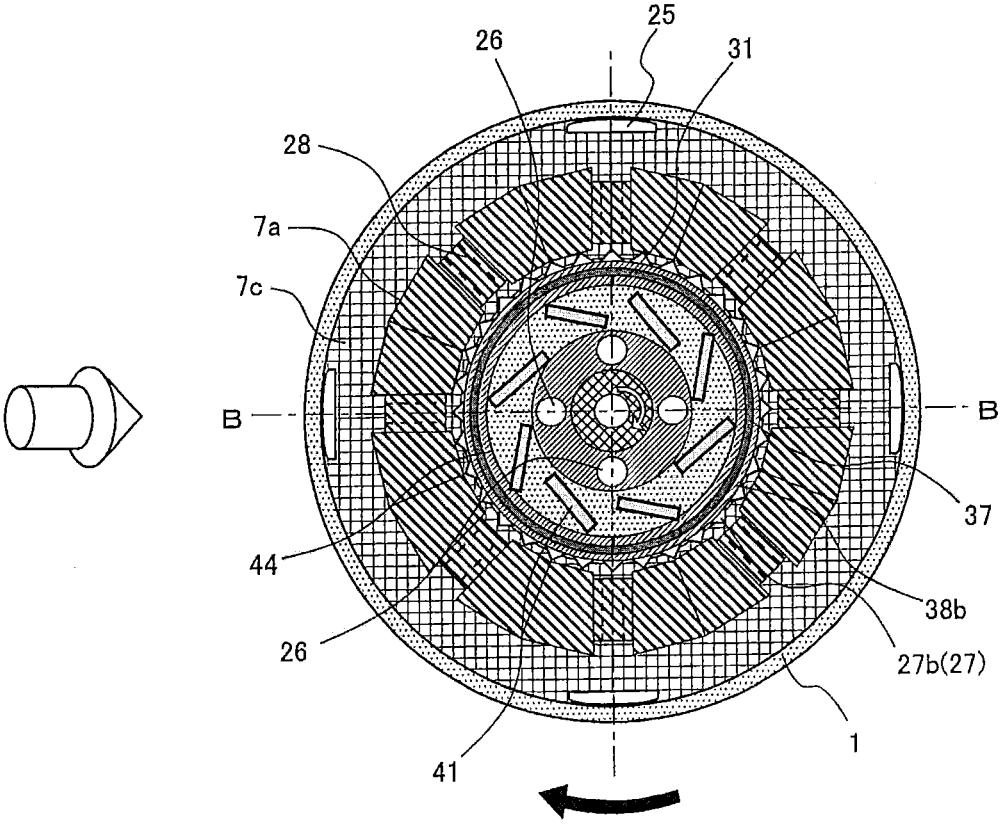
FIG. 2 is a horizontal sectional view of the structure of the hermetic compressor according to Embodiment 1 of the present invention (sectional view taken along the line A-A in FIG. 1).

FIG. 1 is a vertical sectional view of a structure of a hermetic compressor according to Embodiment 1 of the present invention. FIG. 2 is a horizontal sectional view of the structure of the hermetic compressor according to Embodiment 1 of the present invention (sectional view taken along the line A-A in FIG. 1). Note that, the solid arrow shown in FIG. 2 indicates a rotation direction of the rotary pressure increasing mechanism.

First, with reference to FIGS. 1 and 2, a fundamental structure and operation of a hermetic compressor 100 according to Embodiment 1 is described.

<Fundamental Structure and Operation of Hermetic Compressor 100>

The hermetic compressor 100 according to Embodiment 1 is a high-pressure shell hermetic scroll compressor, which includes a hermetic container 1 having a bottom portion in which a lower oil reservoir 2 for storing lubricating oil is formed, and an electric motor 8, a drive shaft 3, a compression mechanism 60, and a rotary pressure increasing mechanism 49 that are housed in the hermetic container 1.

The electric motor 8 includes a substantially cylindrical stator 7 having an inner peripheral portion through which a through-hole is formed in a vertical direction, and a substantially cylindrical rotator 6 arranged on an inner peripheral side of the stator 7 across a predetermined air gap 27*a*. The electric motor 8 according to Embodiment 1 is, for example, a DC brushless motor. The stator 7 is formed of laminated steel plates, and includes a core 7*c* that is formed into a wound coil block by winding a coil therearound at a high density. Further, at an upper end of the stator 7, coil parts projecting from the wound coil block toward an upper side of the stator 7, that is, a plurality of electric motor upper coil-interconnecting portion 7*a* are formed. At a lower end of the stator 7, coil parts projecting from the wound coil block toward a lower side of the stator 7, that is, a plurality of electric motor lower coil-interconnecting portions 7*b* are formed. This stator 7 is attached to an inner peripheral surface of the hermetic container 1 by press fitting, welding, and the like. Note that, an outer peripheral portion of the core 7*c* of the stator 7 is partially cut out so that stator outer peripheral passages 25 are formed between the core 7*c* and the hermetic container 1 under a state in which the stator 7 is attached to the inner peripheral surface of the hermetic container 1.

The rotator 6 is formed by laminating steel plates and sandwiching uppermost and lowermost ones of the laminated steel plates respectively with a rotator upper end fixing substrate 33 and a rotator lower end fixing substrate 34. Further, magnets are arranged in the rotator 6. Still further, respectively on an upper surface of the rotator upper end fixing substrate 33 and a lower surface of the rotator lower end fixing substrate 34, an upper balance weight 31 and a lower balance weight 32, which have a predetermined thickness and are arranged in reverse phases, are arranged along outer rims of the rotator 6. Yet further, four rotator vents 26 are formed in the vertical direction through the rotator 6 according to Embodiment 1. Note that, the number of the rotator vents 26 is not particularly limited as long as at least one rotator vent 26 is formed.

A lower end portion of the drive shaft 3 is attached to the rotator 6 of the electric motor 8, and an upper end portion thereof is attached to the compression mechanism 60 described below. In other words, the drive shaft 3 is configured to transmit a driving force of the electric motor 8 to the compression mechanism 60. An upper side of the drive shaft 3 is held in a freely rotatable manner by a main bearing unit 55 of an upper bearing member 11 arranged above the electric motor 8, and a lower side thereof is held in a freely rotatable manner by a sub bearing unit 54 of a lower bearing member 12 arranged below the electric motor 8.

The compression mechanism 60 is arranged above the electric motor 8, and includes a fixed scroll 51 and an orbiting scroll 52. Plate-like scroll teeth are formed on a lower surface of the fixed scroll 51, which is attached to a compression mechanism casing 50 that is fixed to the inner peripheral surface of the hermetic container 1. Plate-like scroll teeth to mesh with the plate-like scroll teeth of the fixed scroll 51 are formed on an upper surface of the orbiting scroll 52, which is provided in a freely slidable manner at the upper end portion of the drive shaft 3. When the plate-like scroll teeth of the fixed scroll 51 and the plate-like scroll teeth of the orbiting scroll 52 mesh with each other, compression chambers 4 are formed between the plate-like scroll teeth on both sides. A lower surface of the orbiting scroll 52 is supported in a freely slidable manner by an upper surface portion of the upper bearing member 11. An outer peripheral surface of the upper bearing member 11 is supported in a freely slidable manner by an inner peripheral surface of the compression mechanism casing 50. With this configuration, the upper bearing member 11 can be retracted downward in response to application of pressure of a predetermined value or more in the compression chamber 4, and thus an abnormal pressure increase in the compression chamber 4 can be avoided.

Note that, a refrigerant passage 57 is formed between an outer peripheral portion of the compression mechanism casing 50 and the hermetic container 1. Further, a discharge cover 56 for partitioning an electric motor superjacent space 9 (more specifically, upper part of a cylindrical lateral wall 37 described below) into an electric motor stator superjacent space 9*a* (outer space) and an electric motor rotator superjacent space 9*b* (inner space) is arranged under the compression mechanism casing 50.

The rotary pressure increasing mechanism 49 is arranged on an upper portion of the rotator 6. The rotary pressure increasing mechanism 49 according to Embodiment 1 is a centrifugal impeller 40, which includes a plurality of vanes 41 arranged in a manner of extending from an inner peripheral side to an outer peripheral side about the drive shaft 3. Further, the centrifugal impeller 40 according to Embodiment 1 also includes a vane superjacent disk 43 (upper surface plate) for blocking inflow of refrigerant gas from above the vanes 41 into the centrifugal impeller 40, and a vane subjacent disk 44 (lower surface plate) for blocking inflow of refrigerant gas from below the vanes 41 into the centrifugal impeller 40. Further, to prevent inflow of refrigerant gas through passages other than the rotator vents 26 into an inlet on an inner peripheral side of the centrifugal impeller 40, an inner peripheral flow guide 42 (partition plate) is extended downward from a rim of an opening portion of the vane subjacent disk 44, which is formed at a position on an inner peripheral side of the vanes 41, in a manner that an outer peripheral portion of the rotator vents 26 is surrounded. The centrifugal impeller 40 is rotated about the drive shaft 3 through, for example, connection between the drive shaft 3 and the vane superjacent disk 43, connection between the cylindrical lateral wall 37 described below and the vane subjacent disk 44, or connection between the rotator 6 and the inner peripheral flow guide 42. With this configuration, the refrigerant that flows in through the inlet on the inner peripheral side is increased in pressure and is caused to flow out through an outlet on the outer peripheral side.

Further, in the hermetic compressor 100 according to Embodiment 1, the cylindrical lateral wall 37 is arranged to surround the centrifugal impeller 40 (more specifically, refrigerant outlet on the outer peripheral side), in other words, to partition the electric motor superjacent space 9 into the electric motor stator superjacent space 9*a* (outer space) and the electric motor rotator superjacent space 9*b* (inner space). Further, in the cylindrical lateral wall 37, an oil drain hole is formed on a rotation direction leading end portion 31*a* side of the upper balance weight 31. This cylindrical lateral wall 37 is attached to an upper surface portion of a disk portion 38*a* of a balancer fixing bottom plate 38 for fixing the upper balance weight 31 to the rotator upper end fixing substrate 33. Further, in Embodiment 1, a stator inner peripheral passage closing portion 38*b* (closing member) is arranged to project from an outer peripheral portion of the disk portion 38*a* of the balancer fixing bottom plate 38. This stator inner peripheral passage closing portion 38*b* is arranged to close an upper part of a stator inner peripheral passage 27 formed between the rotator 6 and the stator 7 (specifically, air gap 27*a* between the rotator 6 and the stator 7, and core inner peripheral portion cut-out passage 27*b* formed by cutting out the inner peripheral side of the stator 7).

In the hermetic compressor 100 configured as described above, the orbiting scroll 52 of the compression mechanism 60 performs eccentric orbital operation along with rotation of the drive shaft 3, causing sucked low-pressure refrigerant to enter the compression chamber 4 through a compressor suction pipe 21. Then, the sucked pressure refrigerant is increased in pressure through a compression step of gradually decreasing a volume of the compression chamber 4, and is discharged into a discharge space 10 ((1) in FIG. 1) in the hermetic container 1 through a discharge port 18 of the fixed scroll 51.

Further, along with the rotation of the drive shaft 3, the lubricating oil stored in the lower oil reservoir 2 is sucked upward from a lower end of the drive shaft 3, and flows into a hollow hole 3*a*. Part of the lubricating oil is supplied, for example, to the sub bearing unit 54 and the main bearing unit 55 through oil supply holes (not shown). Further, part of the lubricating oil flows out from an upper end of the drive shaft 3, and then is supplied into the compression chamber 4 through, for example, a gap between the upper bearing member 11 and the orbiting scroll 52 and an oil supply hole 3*b*, increasing effects of lubrication of the compression mechanism 60 and sealing of the compressed gas. The lubricating oil that is supplied in the compression chamber 4 is discharged into the discharge space 10 ((1) in FIG. 1) in the hermetic container 1 through the discharge port 18 of the fixed scroll 51 together with the refrigerant compressed to have a high pressure in the compression chamber 4.

<Flow of Refrigerant in Hermetic Container>

The refrigerant that is discharged through the discharge port 18 flows downward through the refrigerant passage 57 formed of a gap between an outer peripheral side of the compression mechanism casing 50 and the hermetic container 1, and reaches the electric motor stator superjacent space 9*a* ((2) in FIG. 1). Further, this refrigerant flows downward into an electric motor stator subjacent space ((3) in FIG. 1) in an electric motor subjacent space 5 through the stator outer peripheral passages 25 formed between the core 7*c* of the stator 7 and the hermetic container 1, and reaches the lower bearing member 12 including the sub bearing unit 54. During this process, the refrigerant and the lubricating oil mixed in an atomized form with the refrigerant are separated from each other, and the separated lubricating oil is refluxed to the lower oil reservoir 2 through an oil return hole 12*a* formed through the lower bearing member 12.

Meanwhile, the refrigerant that flows in the electric motor stator subjacent space in the electric motor subjacent space 5 flows up from an electric motor rotator subjacent space ((4) in FIG. 1) in the electric motor subjacent space 5 through the rotator vents 26 into a vane inner passage 46 of the centrifugal impeller 40 attached on an upper portion of the rotator 6 (passage on an inner peripheral side of the inner peripheral flow guide 42, that is, space represented by (5) in FIG. 1). Then, the refrigerant that flows in the vane inner passage 46 is sucked into inter-vane passages 47 formed between the vanes 41 of the centrifugal impeller 40, flows to the outer peripheral side while being increased in pressure in accordance with a rotational speed of the centrifugal impeller 40, and, on an outer peripheral side of the vanes 41, flows up through a vane outer passage 48 formed in a region on an inner peripheral side of the cylindrical lateral wall 37. Then, this refrigerant is once released into the electric motor rotator superjacent space 9*b* ((6) in FIG. 1) that is formed above the circular vane superjacent disk 43 covering upper surfaces of the vanes 41 of the centrifugal impeller 40 and on the inner peripheral side of the cylindrical lateral wall 37. With this, static pressure is increased. After that, the refrigerant that flows in the electric motor rotator superjacent space 9*b* ((6) in FIG. 1) flows into the discharge cover 56 through an opening portion 56*a* of the discharge cover 56, and then is discharged into an external circuit on an outside of the hermetic container 1 through a compressor discharge pipe 22 that communicates to an inner space of the discharge cover 56.

<Flow in Short Circuit Passage 23 and Short-Circuit Prevention>

To prevent electrical short-circuiting between the electric motor upper coil-interconnecting portions 7*a* and the discharge cover 56, a gap between the electric motor upper coil-interconnecting portions 7*a* and the discharge cover 56, that is, a short circuit passage 23 needs to be formed. Thus, during the process from the discharge space 10 ((1) in FIG. 1) to the electric motor rotator superjacent space 9*b* ((6) in FIG. 1), the refrigerant may flow from the electric motor stator superjacent space 9*a* ((2) in FIG. 1) directly into the electric motor rotator superjacent space 9*b* ((6) in FIG. 1) without flowing through the electric motor stator subjacent space ((3) in FIG. 1). As a result, a large number of droplets of unseparated oil may flow out from the hermetic container 1 to the external circuit, which may cause degradation in performance and reliability of the hermetic compressor 100, and degradation in performance of the vapor compression-type refrigeration cycle device (in particular, of the heat exchanger).

In view of the circumstances, to reduce an amount of the flow of the refrigerant that short-circuits to be directly discharged through the short circuit passage 23, the following measures need to be taken.

(1) Set a passage resistance of the short circuit passage 23 to the electric motor rotator superjacent space 9*b* ((6) in FIG. 1) to be sufficiently high.

(2) Increase a pressure in the electric motor rotator superjacent space 9*b* ((6) in FIG. 1) to be close to or higher than a pressure in the electric motor stator superjacent space 9*a*.

Thus, in Embodiment 1, the cylindrical lateral wall 37 is arranged upright to the balancer fixing bottom plate 38 so that a passage area of the short circuit passage 23 is reduced, and thus the passage resistance is increased. Further, a lower end portion of the discharge cover 56 is bent so that a passage shape of the short circuit passage 23 is made complicated, and thus the passage resistance of the short circuit passage 23 is further increased.

In addition, in Embodiment 1, the cylindrical lateral wall 37 is interposed to separate the centrifugal impeller 40 arranged on the rotator 6 and the electric motor upper coil-interconnecting portions 7*a* from each other. With this, the refrigerant gas that is increased in pressure by the centrifugal impeller 40 can be suppressed from reversely flowing into the electric motor stator superjacent space 9*a* ((2) in FIG. 1) through radial passages 28 in the electric motor upper coil-interconnecting portions 7*a*. As a result, the pressure in the electric motor rotator superjacent space 9*b* ((6) in FIG. 1) can be increased.

Note that, other than the rotator vents 26, the stator inner peripheral passage 27 (air gap 27*a* and core inner peripheral portion cut-out passage 27*b*) is formed as an upward refrigerant passage from the electric motor subjacent space 5 ((3) or (4) in FIG. 1) to the electric motor superjacent space 9 ((2) or (5) in FIG. 1), and the pressure increasing effect by the centrifugal impeller 40 cannot be exerted to the refrigerant gas that flows through the stator inner peripheral passage 27. Therefore, a greater pressure increasing effect can be obtained by the centrifugal impeller 40 when the stator inner peripheral passage 27 is closed as much as possible. Thus, in Embodiment 1, to slightly increase an outer diameter of the balancer fixing bottom plate 38 (for example, approximately 1 mm), the stator inner peripheral passage closing portion 38*b* is arranged to the outer peripheral portion of the disk portion 38*a* so that the upper part of the stator inner peripheral passage 27 is closed. With this, an amount of the refrigerant gas that flows through the stator inner peripheral passage 27 can be suppressed, and thus the pressure in the electric motor rotator superjacent space 9*b* ((6) in FIG. 1) can be further increased.

<Design of Centrifugal Impeller>

To increase the pressure in the electric motor rotator superjacent space 9*b* ((6) in FIG. 1) with the centrifugal impeller 40 such that approximately 100% of the refrigerant flows from the electric motor stator superjacent space 9*a* ((2) in FIG. 1) to the electric motor stator subjacent space ((3) in FIG. 1), the shape of the vanes and the passages of the centrifugal impeller 40 need to be designed such that a pressure ($P_6$) in the electric motor rotator superjacent space 9*b* ((6) in FIG. 1) is higher than a pressure ($P_2$) in the electric motor stator superjacent space 9*a* ((2) in FIG. 1). Further, to increase a pressure in the centrifugal impeller 40, input to the compressor (electric power consumption thereof) is increased. Thus, it is also important to design a highly-efficient centrifugal impeller 40.

According to Non Patent Literature 2 (p. 132), of centrifugal fans, a turbofan (having vanes that are formed rearward with respect to a rotation direction) is advantageous in terms of efficiency. Thus, the shape of the vanes 41 of the centrifugal impeller 40 is determined to be rearward with respect to the rotation direction, and eight vanes 41 formed into this shape are arranged in axial symmetry with respect to the drive shaft 3. Further, an inlet angle of each of the vanes 41 is determined such that the vanes 41 each form an angle within a range of ±5 degrees with respect to a circle formed by connecting end positions on the inner peripheral side of the vanes 41. This is because, according to Non Patent Literature 1 (p. 216), a collision loss occurs when an entry angle ib that is equal to a difference between a relative inflow angle β1 and a vane inlet angle β1*b* at an inlet of the impeller ranges from 2 degrees to 5 degrees or more, causing losses in the compressor. Note that, to increase a percentage by which the refrigerant that flows through the rotator vents 26 flows into the inner peripheral side of the centrifugal impeller 40, and then flows out to the outer peripheral side thereof (passage rate), the following configurations are devised.

The rotator vents 26 are arranged on an inner side with respect to the inner peripheral flow guide 42 in plan view.

The vane superjacent disk 43 and the vane subjacent disk 44 for covering the upper and lower sides of the vanes 41 are configured to cover all over the inner peripheral side to the outer peripheral side of the plurality of vanes 41.

With this, the pressure increasing effect by the centrifugal impeller 40 can be further increased, and the pressure in the electric motor rotator superjacent space 9*b* ((6) in FIG. 1) can be further increased.

<Effects>

In the hermetic compressor 100 configured as in Embodiment 1, the pressure in the electric motor rotator superjacent space 9*b* ((6) in FIG. 1) can be increased by using rotation of the rotator 6 in the hermetic container 1. Specifically, when the hermetic compressor 100 that is configured to output three horsepower and operated at a constant speed (50 rps), is operated by using a refrigerant R22 under the condition of Ashrae standard, an effect of increasing the pressure in the electric motor rotator superjacent space 9*b* ((6) in FIG. 1) in units of several kPa can be obtained. As a result, the refrigerant is less liable to flow from the electric motor stator superjacent space 9*a* ((2) in FIG. 1) directly into the electric motor rotator superjacent space 9*b* ((6) in FIG. 1) through the short circuit passage 23, and the large number of droplets of the unseparated oil are less liable to flow out from the hermetic container 1 to the external circuit. Further, to effectively use the sealed lubricating oil, an effect of suppressing the degradation in performance of the hermetic compressor 100, and an effect of suppressing the degradation in reliability thereof due to insufficient lubrication that may be caused by a decrease in amount of the oil stored in the hermetic container 1 can be obtained.

Embodiment 2

Figure 3:
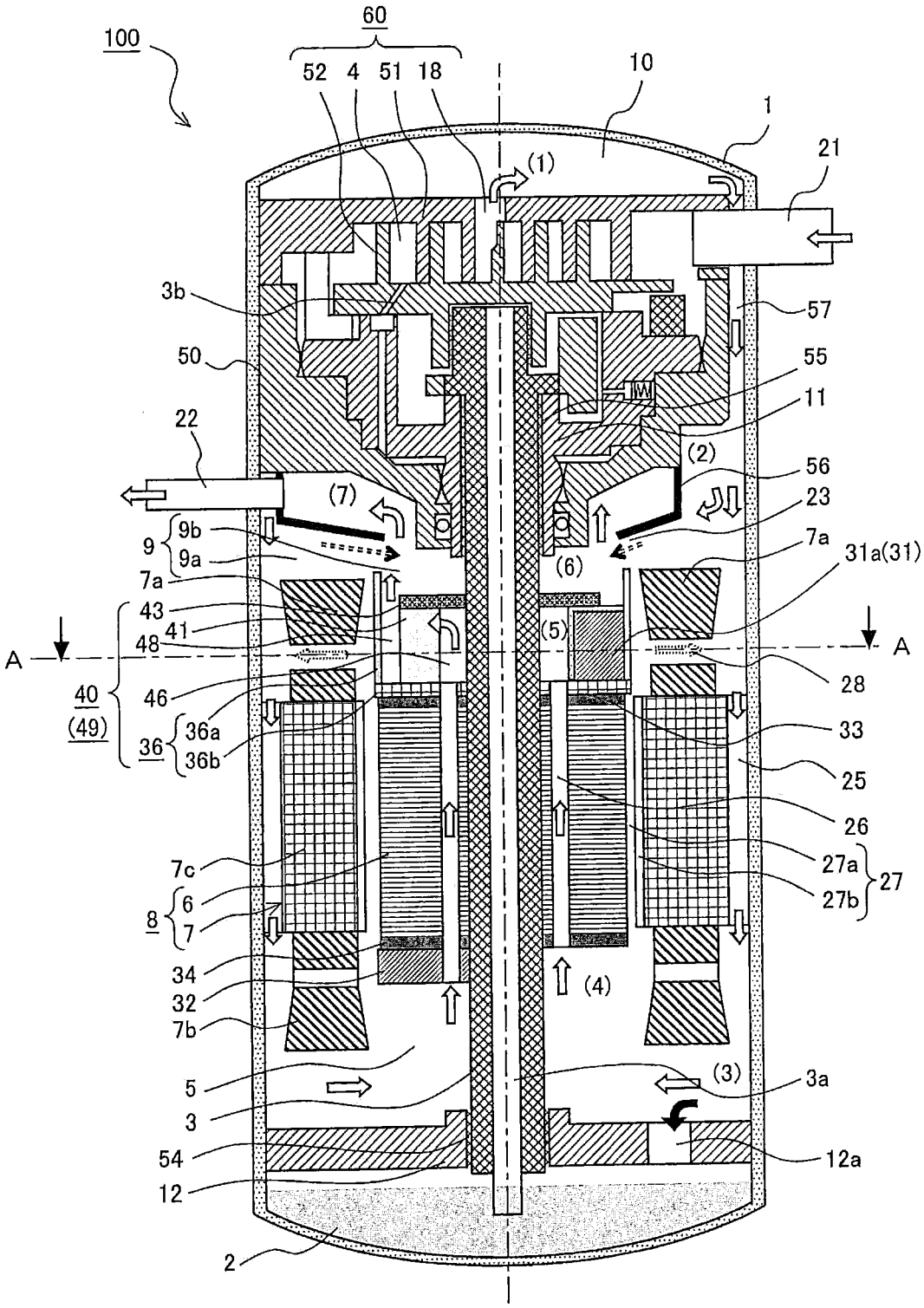
FIG. 3 is a vertical sectional view of a structure of a hermetic compressor according to Embodiment 2 of the present invention.
Figure 4:
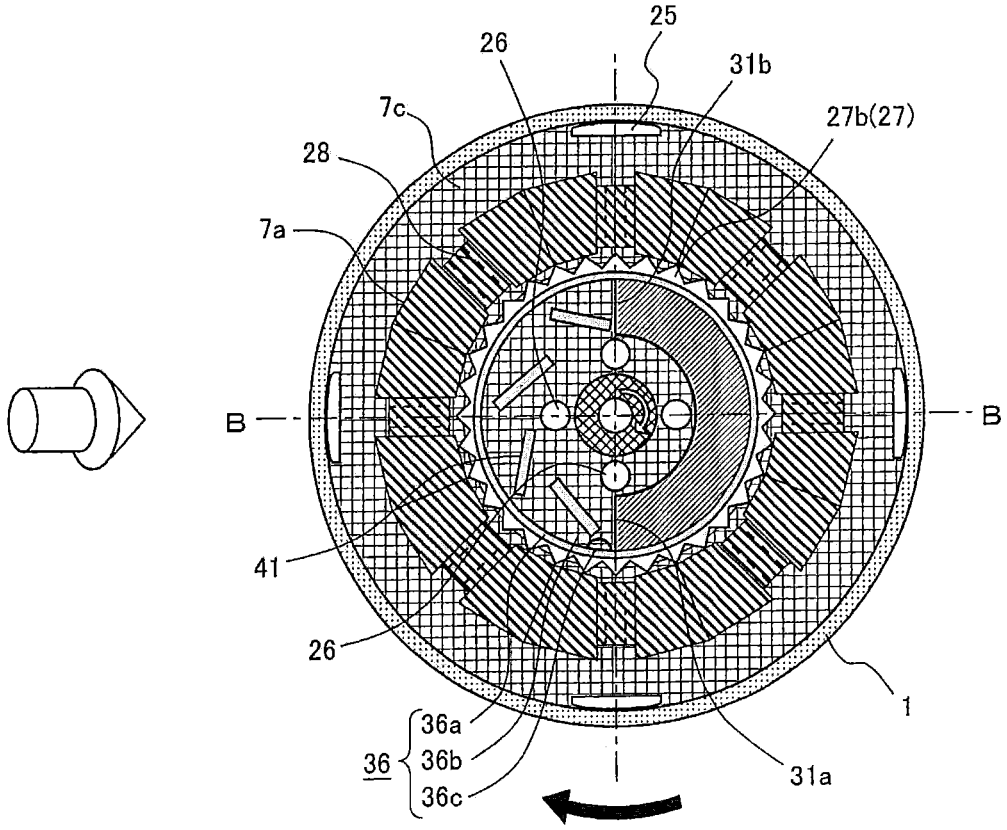
FIG. 4 is a horizontal sectional view of the structure of the hermetic compressor according to Embodiment 2 of the present invention (sectional view taken along the line A-A in FIG. 3).

FIG. 3 is a vertical sectional view of a structure of a hermetic compressor according to Embodiment 2 of the present invention. FIG. 4 is a horizontal sectional view of the structure of the hermetic compressor according to Embodiment 2 of the present invention (sectional view taken along the line A-A in FIG. 3). Note that, the solid arrow shown in FIG. 4 indicates a rotation direction of the rotary pressure increasing mechanism.

Now, with reference to FIGS. 3 and 4, the hermetic compressor 100 according to Embodiment 2 is described. Note that, the fundamental structure and the operation of the hermetic compressor 100 according to Embodiment 2 are the same as those in Embodiment 1, and hence description thereof is omitted.

(1) Embodiment 2 is different from Embodiment 1 in that only four of the eight vanes 41 of the centrifugal impeller 40 in Embodiment 1 that are positioned on one side on which the upper balance weight 31 is absent are left, and that a height of each of the four vanes 41 is designed to be equal to a height of the upper balance weight 31. In Embodiment 1, to allow the refrigerant flowing through the rotator vents 26 to flow out from the centrifugal impeller 40 through the vane inner passage 46, the inner peripheral flow guide 42 and the vane subjacent disk 44 are needed. In contrast, in Embodiment 2, there is an advantage in that the inner peripheral flow guide 42 and the vane subjacent disk 44 can be omitted, and hence the centrifugal impeller 40 is easily processed.

Note that, in a case where the centrifugal impeller 40 is configured as in Embodiment 2, fan efficiency is lower than that of the centrifugal impeller 40 according to Embodiment 1, in which the vanes 41 are arranged in axial symmetry. Further, in the case where the centrifugal impeller 40 is configured as in Embodiment 2, pressure pulsation by the centrifugal impeller 40 is increased in comparison with that by the centrifugal impeller 40 according to Embodiment 1, in which the vanes 41 are arranged in axial symmetry. As a result, vibration and noise may occur. Thus, in a case where the fan efficiency and prevention of the vibration and noise are regarded as important, it is preferred that the centrifugal impeller 40 be configured as in Embodiment 1.

(2) In Embodiment 1, the cylindrical lateral wall 37 for preventing short-circuit flow of the refrigerant through the short circuit passage 23, and the balancer fixing bottom plate 38 for fixing the cylindrical lateral wall 37 are formed as separate members. Meanwhile, in Embodiment 2, the cylindrical lateral wall 37 and the balancer fixing bottom plate 38 according to Embodiment 1 are provided as an oil separating cup 36 obtained by a process of integrating a cylindrical lateral wall 36*a* and a bottom plate 36*b* with each other. Note that, similarly to Embodiment 1, an oil drain hole 36*c* is formed in the oil separating cup 36 on the rotation direction leading end portion 31*a* side of the upper balance weight 31. When the oil separating cup 36 obtained by the process of integrating the cylindrical lateral wall 36*a* and the bottom plate 36*b* with each other is provided instead of the cylindrical lateral wall 37 and the balancer fixing bottom plate 38 according to Embodiment 1, there is an advantage in that a process of assembling the hermetic compressor 100 can be facilitated.

In this way, according to the hermetic compressor 100 configured as in Embodiment 2, the decrease in amount of the lubricating oil stored in the hermetic container 1 can be prevented. In addition, an effect of suppressing reliability degradation caused by insufficient lubrication and an effect of suppressing energy-saving performance degradation, which are comparably less than those in Embodiment 1 but are equivalent thereto, can be obtained. Meanwhile, according to the hermetic compressor 100 configured as in Embodiment 2, there is an advantage in that a manufacturing cost for the centrifugal impeller 40 is lower than that in Embodiment 1.

(3) Note that, other differences between the hermetic compressor 100 according to Embodiment 2 and the hermetic compressor 100 described in Embodiment 1 are as follows.

In the hermetic compressor 100 according to Embodiment 2, the lower end portion of the discharge cover 56 is not subjected to a bending process, and hence the short circuit passage 23 has a simple shape. Thus, in the hermetic compressor 100 according to Embodiment 2, the passage resistance in the short circuit passage 23 is determined based on a size of a smallest gap that is formed between the discharge cover 56 and the cylindrical lateral wall 36*a*.

Further, the hermetic compressor 100 according to Embodiment 2 does not include the closing member for closing the stator inner peripheral passage 27 (counterpart of the stator inner peripheral passage closing portion 38*b* in Embodiment 1).

Embodiment 3

Figure 5:
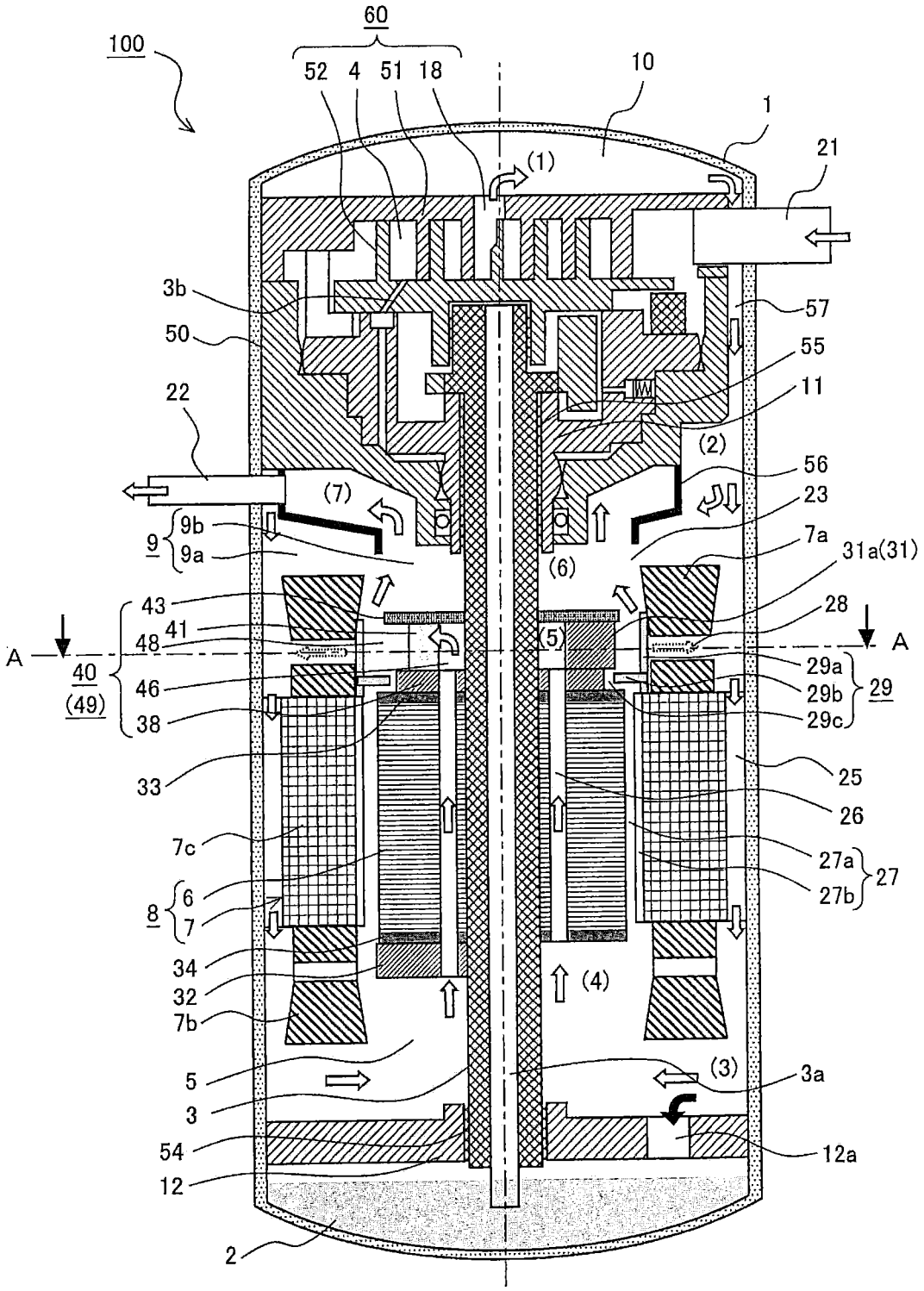
FIG. 5 is a vertical sectional view of a structure of a hermetic compressor according to Embodiment 3 of the present invention.
Figure 6:
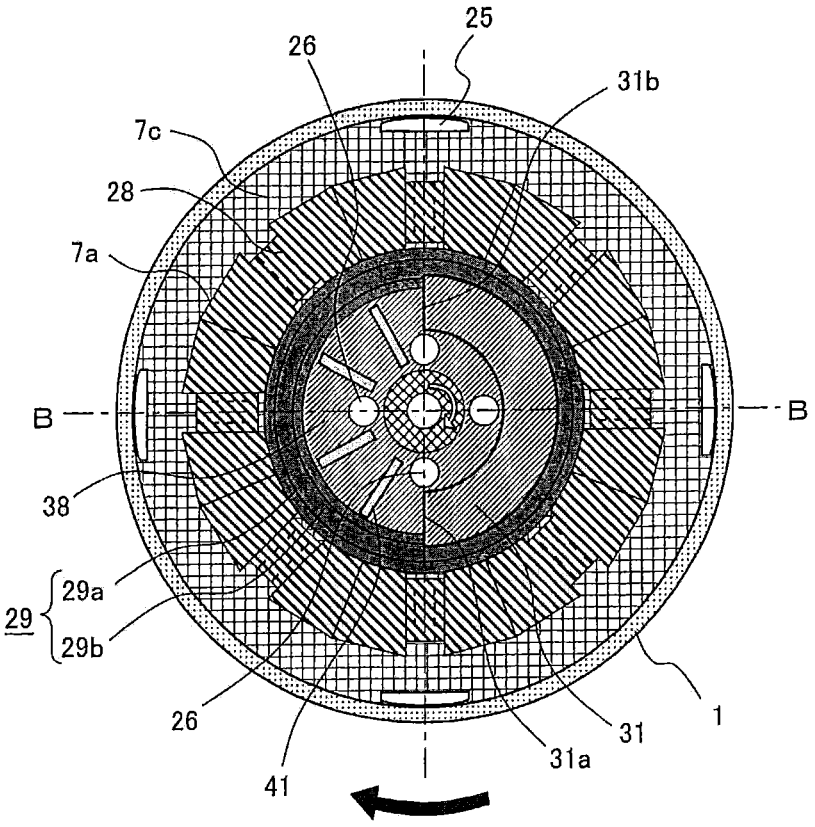
FIG. 6 is a horizontal sectional view of the structure of the hermetic compressor according to Embodiment 3 of the present invention (sectional view taken along the line A-A in FIG. 5).

FIG. 5 is a vertical sectional view of a structure of a hermetic compressor according to Embodiment 3 of the present invention. FIG. 6 is a horizontal sectional view of the structure of the hermetic compressor according to Embodiment 3 of the present invention (sectional view taken along the line A-A in FIG. 5). Note that, the solid arrow shown in FIG. 6 indicates a rotation direction of the rotary pressure increasing mechanism.

Now, with reference to FIGS. 5 and 6, the hermetic compressor 100 according to Embodiment 3 is described. Note that, the fundamental structure and the operation of the hermetic compressor 100 according to Embodiment 3 are the same as those in Embodiment 1, and hence description thereof is omitted.

(1) Similarly to Embodiment 2, in the centrifugal impeller 40 according to Embodiment 3, only four of the eight vanes 41 of the centrifugal impeller 40 in Embodiment 1 that are positioned on the one side on which the upper balance weight 31 is absent are left, and the height of each of the four vanes 41 is designed to be equal to the height of the upper balance weight 31. However, the centrifugal impeller 40 according to Embodiment 3 is different from that according to Embodiment 2 in that the vanes 41 are arranged in a radial direction (direction orthogonal to the rotation direction of the drive shaft 3). With this, although fan efficiency is lower than that of the turbofan, there is an advantage in that the centrifugal impeller 40 can be easily manufactured.

(2) In Embodiments 1 and 2, the cylindrical lateral wall (cylindrical lateral wall 37 or cylindrical lateral wall 36*a*) for preventing the short-circuit flow of the refrigerant through the short circuit passage 23 is arranged on the upper portion of the rotator 6 so that the cylindrical lateral wall is rotated together with the rotator 6. In contrast, in Embodiment 3, a closing cover 29 (more specifically, cylindrical portion 29*a*) as a counterpart of the cylindrical lateral wall is arranged on an inner side of the electric motor upper coil-interconnecting portions 7*a* of the stator 7 so that the radial passages 28 are closed. Further, in the closing cover 29, on an inner peripheral side of the cylindrical portion 29*a*, a projecting portion 29*b* for closing the upper part of the stator inner peripheral passage 27 is formed. This projecting portion 29*b* is a counterpart of the stator inner peripheral passage closing portion 38*b* in Embodiment 1, and is designed such that a smallest gap 29*c* between the projecting portion 29*b* and the disk portion 38*a* of the balancer fixing bottom plate 38 is narrowed (for example, approximately 1 mm to 2 mm) within a range in which electrical short-circuiting does not occur. Note that, in a case where this design is employed, a pressure increasing effect by rotation of the cylindrical lateral wall about the drive shaft cannot be obtained.

In this way, according to the hermetic compressor 100 configured as in Embodiment 3, the decrease in amount of the lubricating oil stored in the hermetic container 1 can be prevented. In addition, the effect of suppressing reliability degradation caused by insufficient lubrication and the effect of suppressing energy-saving performance degradation, which are comparably less than those in Embodiment 1 but are equivalent thereto, can be obtained.

Embodiment 4

Figure 7:
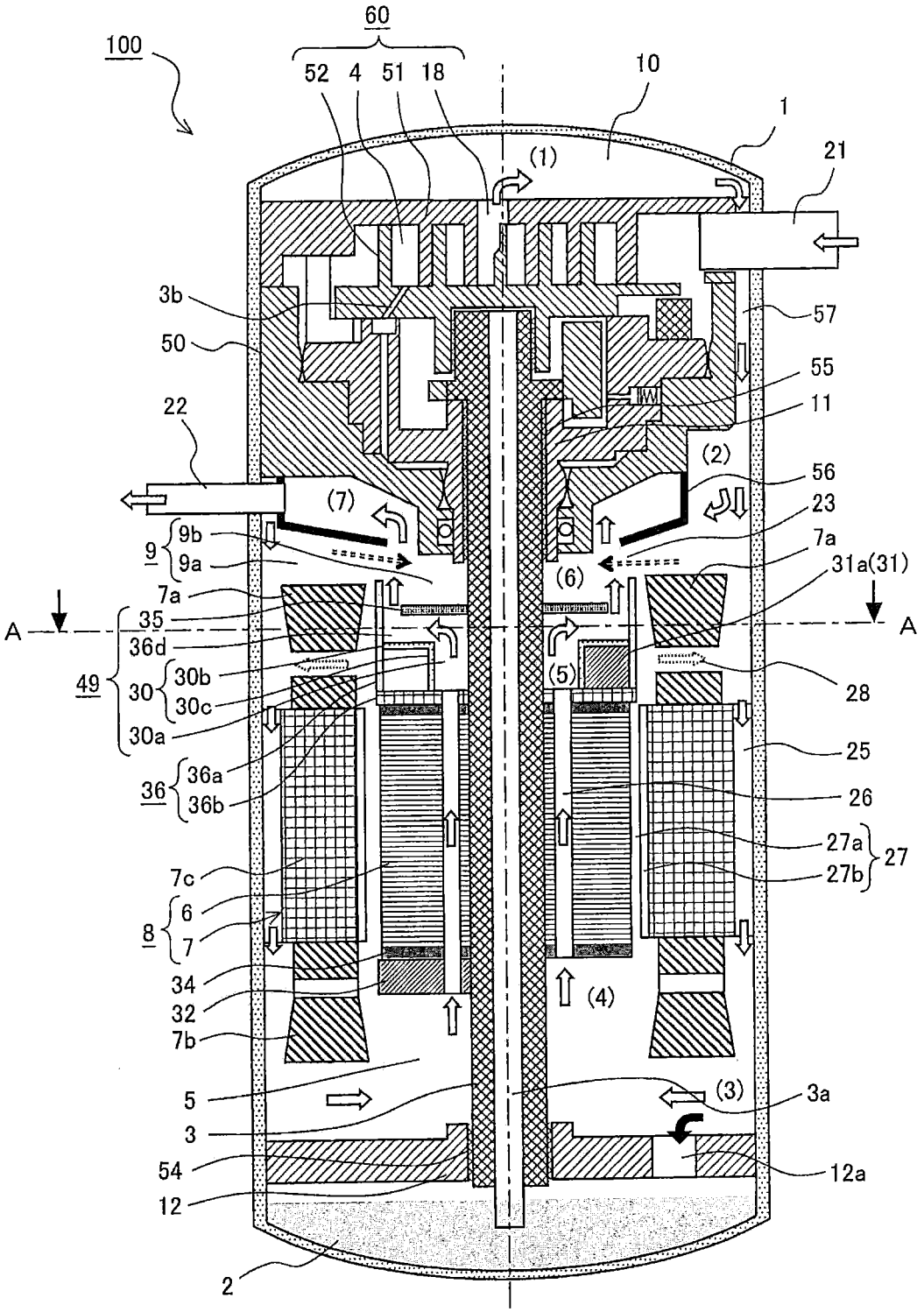
FIG. 7 is a vertical sectional view of a structure of a hermetic compressor according to Embodiment 4 of the present invention.
Figure 8:
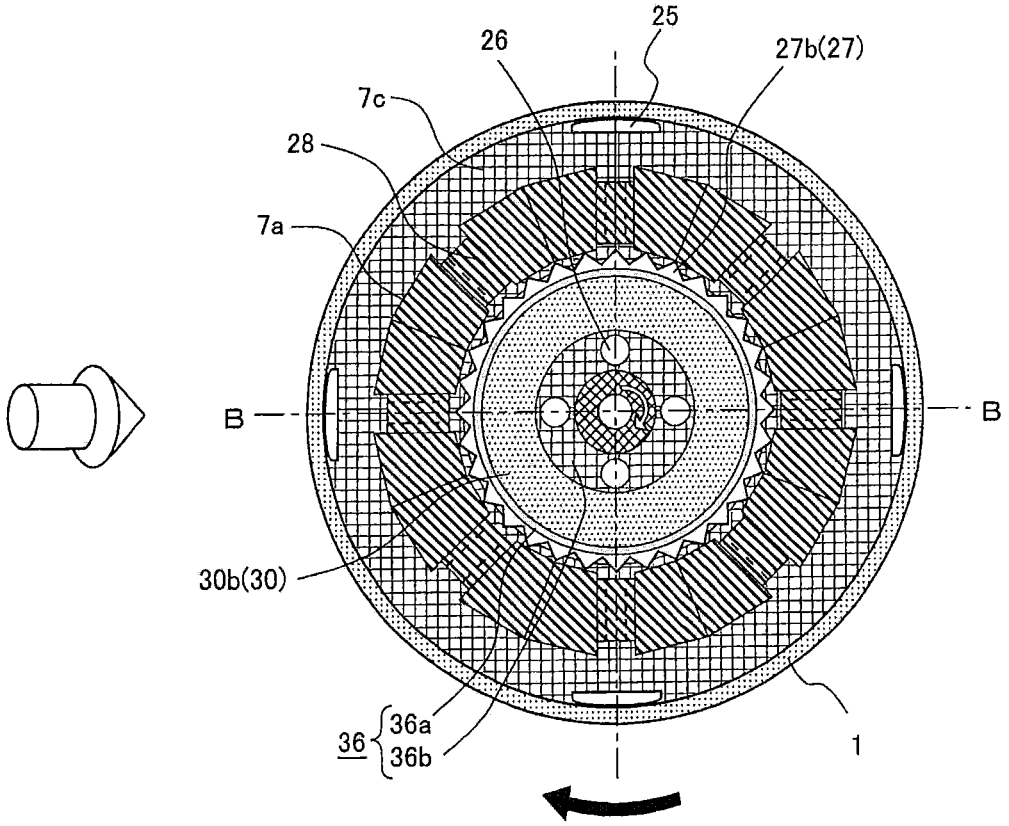
FIG. 8 is a horizontal sectional view of the structure of the hermetic compressor according to Embodiment 4 of the present invention (sectional view taken along the line A-A in FIG. 7).

FIG. 7 is a vertical sectional view of a structure of a hermetic compressor according to Embodiment 4 of the present invention. FIG. 8 is a horizontal sectional view of the structure of the hermetic compressor according to Embodiment 4 of the present invention (sectional view taken along the line A-A in FIG. 7). Note that, the solid arrow shown in FIG. 8 indicates a rotation direction of the rotary pressure increasing mechanism.

Now, with reference to FIGS. 7 and 8, the hermetic compressor 100 according to Embodiment 4 is described. Note that, the fundamental structure and the operation of the hermetic compressor 100 according to Embodiment 4 are the same as those in Embodiment 1, and hence description thereof is omitted.

(1) The configuration of the hermetic compressor 100 according to Embodiment 4 is the same as the configuration of the hermetic compressor 100 described in Embodiment 2 except the configuration of the rotary pressure increasing mechanism 49. Specifically, the rotary pressure increasing mechanism 49 according to Embodiment 4 is obtained by removing all the vanes 41 from the centrifugal impeller 40 described in Embodiment 1. In other words, the rotary pressure increasing mechanism 49 according to Embodiment 4 includes an oil separating rotary disk 35 as a counterpart of the vane superjacent disk 43 in Embodiment 1, and a balancer cover 30 including a rotary disk 30*b* and an inner peripheral flow guide 30*c* as respective counterparts of the vane subjacent disk 44 and the inner peripheral flow guide 42 in Embodiment 1. In the rotary pressure increasing mechanism 49 configured in this way, the refrigerant that flows out from the rotator vents 26 flows into an inner passage 30*a* formed on an inner peripheral side of the inner peripheral flow guide 30*c*, flows between the rotary disk 30*b* and the oil separating rotary disk 35, and flows out into the electric motor rotator superjacent space 9*b* ((6) in FIG. 7) through a cup inner passage 36*d* formed on an inner peripheral side of the oil separating cup 36. In the rotary pressure increasing mechanism 49 according to Embodiment 4, although the great pressure increasing effect (for example, in units of several kPa) by the centrifugal impeller cannot be obtained, a pressure increasing effect (for example, 1 kPa or less) can be obtained by rotations of the rotary disk 30*b* of the balancer cover 30, the oil separating rotary disk 35, and the cylindrical lateral wall 36*a* of the oil separating cup 36.

In this way, according to the hermetic compressor 100 configured as in Embodiment 4, the decrease in amount of the lubricating oil stored in the hermetic container 1 can be prevented. In addition, the effect of suppressing reliability degradation caused by insufficient lubrication and the effect of suppressing energy-saving performance degradation, which are comparably less than (for example, less than half of) those in Embodiment 1 but are equivalent thereto, can be obtained. Meanwhile, according to the hermetic compressor 100 configured as in Embodiment 4, there is an advantage in that a manufacturing cost for the rotary pressure increasing mechanism 49 is lower than that in Embodiment 1.

In Embodiments 1 to 4, the present invention is described with an example of the high-pressure shell hermetic scroll compressor. In this context, also when other rotary compression types (such as sliding-vane type and swing type) are employed, the same effects as those in Embodiments 1 to 4 can be obtained as long as the arrangement of the rotator 6 and the stator 7 of the electric motor 8, and the flow of the refrigerant from the electric motor subjacent space 5 to the electric motor superjacent space 9 are unchanged.

Embodiment 5

In Embodiment 5, an example of the vapor compression-type refrigeration cycle device including the hermetic compressor 100 described in any one of Embodiments 1 to 4 is described.

Figure 9:
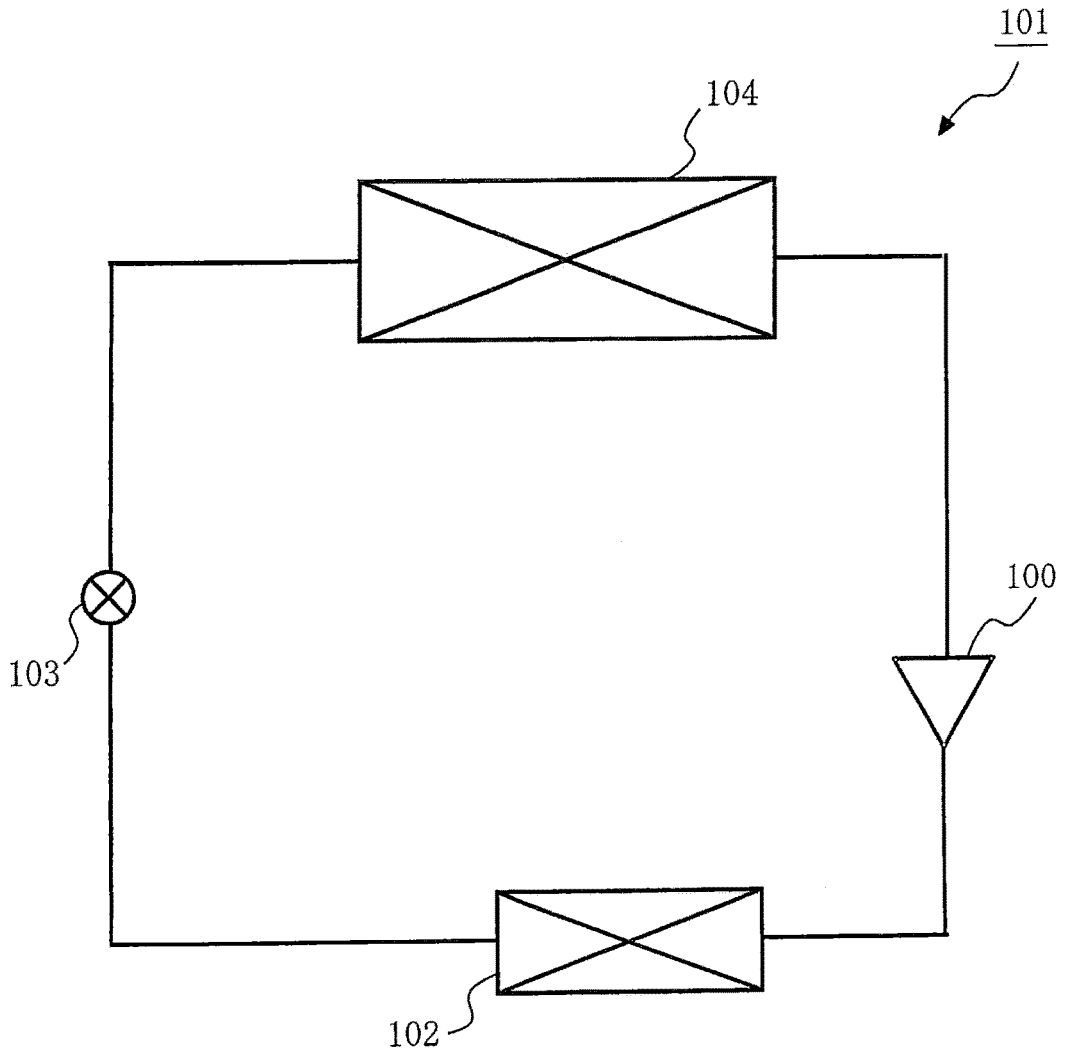
FIG. 9 is a configuration diagram of a vapor compression-type refrigeration cycle device according to Embodiment 5 of the present invention.

FIG. 9 is a configuration diagram of a vapor compression-type refrigeration cycle device 101 according to Embodiment 5. The vapor compression-type refrigeration cycle device 101 includes the hermetic compressor 100 described in any one of Embodiments 1 to 4, a radiator 102 for transferring heat of the refrigerant compressed by the hermetic compressor 100, an expansion mechanism 103 for expanding the refrigerant that flows out from the radiator 102, and an evaporator 104 for causing the refrigerant that flows out from the expansion mechanism 103 to receive heat. When the hermetic compressor 100 according to any one of Embodiments 1 to 4 is used in the vapor compression-type refrigeration cycle device 101, the vapor compression-type refrigeration cycle device 101 can be improved in energy saving efficiency, reduced in vibration and noise, and increased in reliability.

REFERENCE SIGNS LIST

1 hermetic container 2 lower oil reservoir 3 drive shaft 3*a* hollow hole 3*b* oil supply hole 4 compression chamber 5 electric motor subjacent space 6 rotator

7 stator 7*a* electric motor upper coil-interconnecting portion 7*b* electric motor lower coil-interconnecting portion 7*c* core 8 electric motor 9 electric motor superjacent space 9*a* electric motor stator superjacent space 9*b* electric motor rotator superjacent space 10 discharge space 11 upper bearing member 12 lower bearing member 12*a* oil return hole 18 discharge port 21 compressor suction pipe 22 compressor discharge pipe 23 short circuit passage 25 stator outer peripheral passage 26 rotator vent 27 stator inner peripheral passage 27*a* air gap 27*b* core inner peripheral portion cut-out passage 28 radial passage 29 closing cover 29*a* cylindrical portion 29*b* projecting portion for closing stator inner peripheral passage 29*c* smallest gap 30 balancer cover 30*a* inner passage 30*b* rotary disk 30*c* inner peripheral flow guide 31 upper balance weight 31*a* rotation direction leading end portion 31*b* rotation direction trailing end portion 32 lower balance weight 33 rotator upper end fixing substrate 34 rotator lower end fixing substrate 35 oil separating rotary disk (single member) 36 oil separating cup 36*a* cylindrical lateral wall 36*b* bottom plate

36*c* oil drain hole 36*d* cup inner passage 37 cylindrical lateral wall (single member) 38 balancer fixing bottom plate 38*a* disk portion 38*b* stator inner peripheral passage closing portion 40 centrifugal impeller 41 vane 42 inner peripheral flow guide 43 vane superjacent disk 44 vane subjacent disk 46 vane inner passage 47 inter-vane passage 48 vane outer passage 49 rotary pressure increasing mechanism 50 compression mechanism casing 51 fixed scroll 52 orbiting scroll 54 sub bearing unit 55 main bearing unit 56 discharge cover 56*a* opening portion 57 refrigerant passage 60 compression mechanism 100 hermetic compressor 101 vapor compression-type refrigeration cycle device 102 radiator 103 expansion mechanism 104 evaporator

The invention claimed is:

1. A hermetic compressor, comprising:

a hermetic container having a bottom portion for storing lubricating oil;

an electric motor arranged in the hermetic container, the electric motor including:

a stator; and a rotator through which at least one rotator vent is formed in a vertical direction;

a drive shaft attached to the rotator;

a compressor arranged in the hermetic container, for compressing refrigerant by using rotation of the drive shaft, an impeller arranged on an upper portion of the rotator, for increasing a pressure of refrigerant gas by allowing the refrigerant gas to flow through the impeller while rotating about the drive shaft, a cylindrical lateral wall for partitioning a space above the electric motor into an outer space on the stator side and inner space on the rotator side such that the cylindrical lateral wall surrounds an outer peripheral side of the impeller positioned in the inner space, the cylindrical lateral wall being arranged so that the refrigerant gas, which flows from an inner peripheral side of the impeller to the outer peripheral side of the impeller, flows between an inner peripheral side of the cylindrical lateral wall and the outer peripheral side of the impeller; and a discharge pipe communicated to the inner space, for allowing the refrigerant to flow out from the inner space into an external circuit that is external to the hermetic container, wherein the refrigerant gas that is compressed by the compressor and discharged into the hermetic container is moved from a space below the electric motor up to an upper end of the rotator through the at least one rotator vent, flows into the impeller to be increased in pressure, flows into the inner space to increase a pressure in the inner space, and is discharged to an outside through the discharge pipe while suppressing inflow of the refrigerant gas from the outer space to the inner space.

2. The hermetic compressor of claim 1, wherein the impeller comprises a centrifugal impeller that is rotated about the drive shaft so that the refrigerant gas flows into the centrifugal impeller through an inlet on an inner peripheral side, and flows out through an outlet on an outer peripheral side while being increased in pressure.

3. The hermetic compressor of claim 2, wherein the cylindrical lateral wall is arranged to surround the outlet on the outer peripheral side of the centrifugal impeller.

4. The hermetic compressor of claim 2, wherein the centrifugal impeller comprises:

a lower surface plate for blocking inflow of the refrigerant gas from a region below vanes of the centrifugal impeller into the centrifugal impeller;

an upper surface plate for blocking inflow of the refrigerant gas from a region above the vanes of the centrifugal impeller into the centrifugal impeller; and a partition plate for blocking inflow of the refrigerant gas into the inlet on the inner peripheral side of the centrifugal impeller through passages other than the at least one rotator vent.

5. The hermetic compressor of claim 1, wherein the stator comprises a plurality of electric motor upper coil-interconnecting portions formed of projecting parts of a coil wound around a core, the projecting parts projecting from an upper end of the stator, and wherein the cylindrical lateral wall is interposed to separate the impeller and the electric motor upper coil-interconnecting portions from each other.

6. The hermetic compressor of claim 1, further comprising a closing member for closing an upper part of a passage formed between the rotator and the stator.

7. The hermetic compressor of claim 1, wherein the cylindrical lateral wall is arranged to the upper end of the rotator, and is rotated together with the rotator.

8. The hermetic compressor of claim 1, wherein the compressor is arranged above the electric motor, and wherein the refrigerant gas that is compressed by the compressor and discharged into the hermetic container flows from the outer space into the space below the electric motor through stator outer peripheral passages formed between the stator and the hermetic container, is moved from the space below the electric motor up to the upper end of the rotator through the at least one rotator vent, flows into the impeller to be increased in pressure, flows into the inner space to increase the pressure in the inner space, and is discharged to the outside through the discharge pipe while suppressing the inflow of the refrigerant gas from the outer space to the inner space.

9. The hermetic compressor of claim 8, further comprising a discharge cover for partitioning a part of the space above the electric motor, the discharge cover being positioned above the cylindrical lateral wall, into the outer space and the inner space, the discharge cover being arranged under the compressor, wherein the discharge cover and the cylindrical lateral wall are used to increase a passage resistance of a short circuit passage that communicates the outer space and the inner space to each other.

10. A vapor compression-type refrigeration cycle device, comprising:

the hermetic compressor of claim 1;

a radiator for transferring heat of refrigerant that is compressed by the hermetic compressor;

an expansion valve for expanding the refrigerant that flows out from the radiator; and an evaporator for causing the refrigerant that flows out from the expansion valve to receive heat.

* * * * *